United States Patent [19]

Rubin et al.

[11] 4,044,514

[45] Aug. 30, 1977

[54] IN GROUND SWIMMING POOL FRAMEWORK

[75] Inventors: Philip N. Rubin, Trumbull; Michael Fleming, Easton, both of Conn.

[73] Assignee: Fairfield Fiberglass Inc., Fairfield, Conn.

[21] Appl. No.: 642,556

[22] Filed: Dec. 19, 1975

[51] Int. Cl.[2] ..... E04H 3/18

[52] U.S. Cl. ..... 52/169.7; 4/172.19; 52/309.13

[58] Field of Search ..... 52/169, 309, 169.7, 52/309.1, 309.13; 4/172, 172.19

[56] References Cited

U.S. PATENT DOCUMENTS

| | | | |
|---|---|---|---|
| 3,242,624 | 3/1966 | Stier | 52/169 |
| 3,396,500 | 8/1968 | Lankheet | 52/169 |
| 3,739,539 | 6/1973 | Posnick | 4/172.19 |
| 3,745,727 | 7/1973 | Chichester | 52/169 |
| 3,885,364 | 5/1975 | Lankheet | 52/169 |

FOREIGN PATENT DOCUMENTS

| | | | |
|---|---|---|---|
| 2,001,225 | 7/1971 | Germany | 4/172.19 |

*Primary Examiner*—J. Karl Bell
*Attorney, Agent, or Firm*—Ernest M. Junkins

[57] ABSTRACT

A swimming pool framework for defining an in ground opening for receiving a water containing liner in which the framework consists of a plurality of joined together arcuate and straight panels with the panels being rigid and formed of hardened polyester resin containing glass fibers.

10 Claims, 7 Drawing Figures

IN GROUND SWIMMING POOL FRAMEWORK

The present invention relates to an in ground swimming pool of the type that uses a unitary, plastic, flexible liner for containing the water. The liner is disposed within a depression formed in the ground with the lower portion of the depression being generally defined by a layer of sand while the upper portion is defined by a framework formed by joining individual panels together. The periphery of the liner is secured to the top edge of the panels to depend therefrom into the depression and lie against the inner surface of the panels while earth is back filled against the outer surface of the panels. A cement walkway may extend around the framework to be essentially flush therewith, if desired.

In such a pool, it is essential that the panels retain their shape and strength for a long period in order to properly support the liner against water pressure to thereby provide a satisfactory pool. However, in heretofore suggested rigid framework pools, difficulty in achieving such attributes of the panels has been encountered. When the framework has been formed of wood panels, they tended to be subject to rotting, warping and splintering, while if the panels were formed of metal, they tended to pit, corrode and dent, each of which renders the framework unsatisfactory.

It is accordingly an object of the present invention to provide a framework for an in ground water containing liner type swimming pool which provides a rigid support for the liner even over an extended period of use.

Another object of the present invention is to achieve the above object with a framework of joined together panels in which the panels are quite resistant to deformation while in use and even during construction.

A further object of the present invention is to provide a framework for a swimming pool which is capable of being used with other existing components forming the pool, is relatively economical to manufacture, uses similar techniques for construction as in heretofore known framework pools and which is capable of forming pools having arcuate peripheries.

In carrying out the present invention, a swimming pool framework is formed to have a shape that is preferably compatible with conventionally sized plastic liners with one shape being essentially rectilinear with semi-circular ends. The framework consists of joined together arcuate and straight panels that are disposed within the ground and which may have sunken braces that extend outwardly therefrom. In accordance with the present invention, each panel is formed as a rigid entity from hardened polyester resin having glass fibers embedded therein, generally referred to as fiberglass material, with integral ribs on the exterior of the panel so that irrespective of whether the panel is arcuate or straight, its rigidity is assured. The use of fiberglass material as the material from which the panels are formed together with the integral flanges and strengthening ribs, provides a panel which has sufficient strength and rigidity to support the liner while being capable of resisting deterioration of these characteristics even when sunk in the earth for an extended period of time.

Other features and advantages will hereinafter appear.

In the drawing

Figure 1:
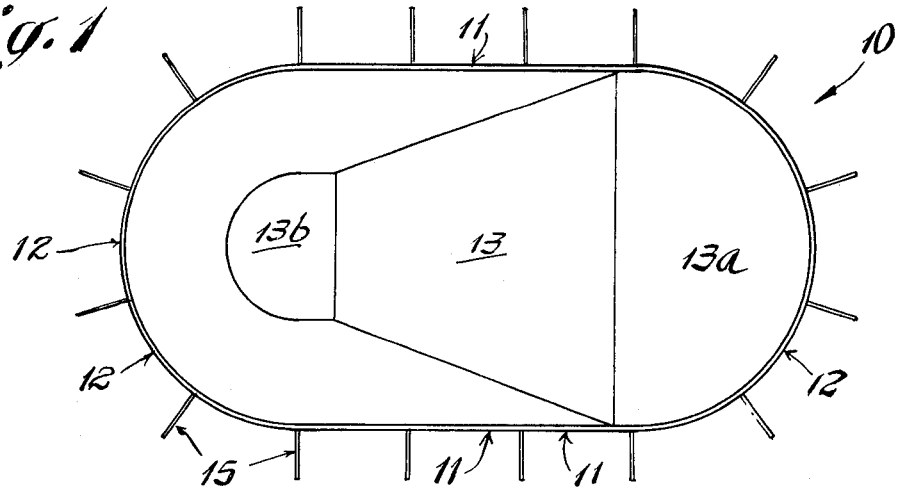
FIG. 1 is a diagrammatic plan of a pool having a framework.

Referring to the drawing, the swimming pool framework of the present invention is generally indicated by the reference numeral 10 and includes a plurality of straight panels 11 and arcuate panels 12 that are joined together to define a pool that is essentially rectilinear with semi-circular end portions. The panels are laid on end and extend perhaps 39 inches into the ground so as to define a pool depression 13. The bottom of the depression is preferably shaped so as to have portions of different depths with, for example, a portion **13*a* being of a depth of almost 4 feet and a portion 13*b* a depth of 7 or 8 feet. The bottom of the depression is preferably defined by a layer of sand. A flexible plastic liner 14 for containing water may have its peripheral edge portion secured on the top peripheral surface of the framework and depend into the depression to rest against the interior of the framework and the shaped sand covered bottom of the depression. Preferably, braces 15** are connected to the panels to extend outwardly therefrom to effect support and anchoring of the framework in the ground.

Figure 2:
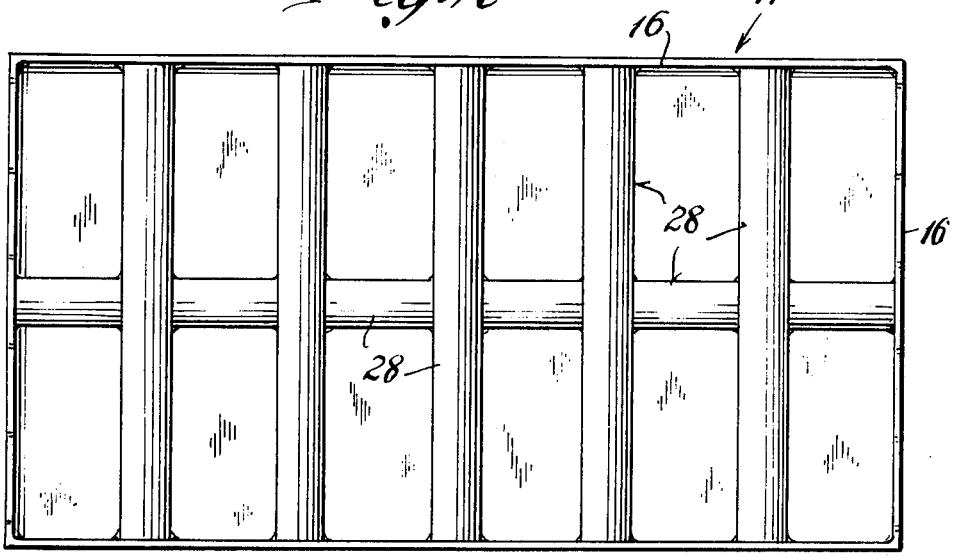
FIG. 2 is a side view of the exterior of a straight panel.
Figure 3:
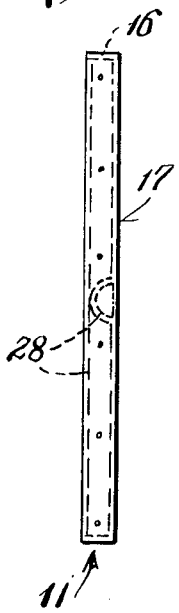
FIG. 3 is an end view thereof.
Figure 4:
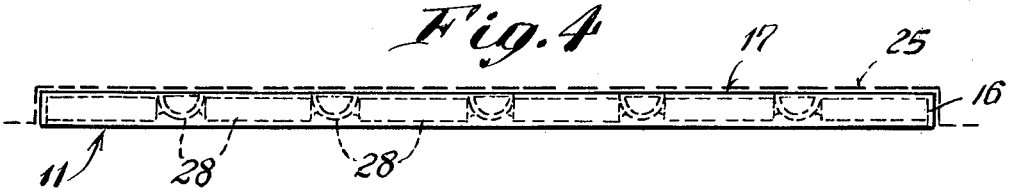
FIG. 4 is a top view thereof.
Figure 5:
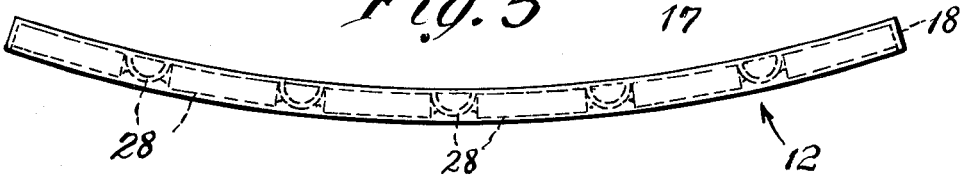
FIG. 5 is a top view of a curved panel.

Referring to FIGS. 2, 3 and 4, there is shown a straight panel 11 having a flat integral flange 16 that extends about the periphery thereof and extends outwardly from the panel's smooth inner surface 17 which defines the interior of the depression. Similarly, the arcuate panel 12 is also formed to have an outwardly extending peripheral flange 18.

Figures 6, 7:
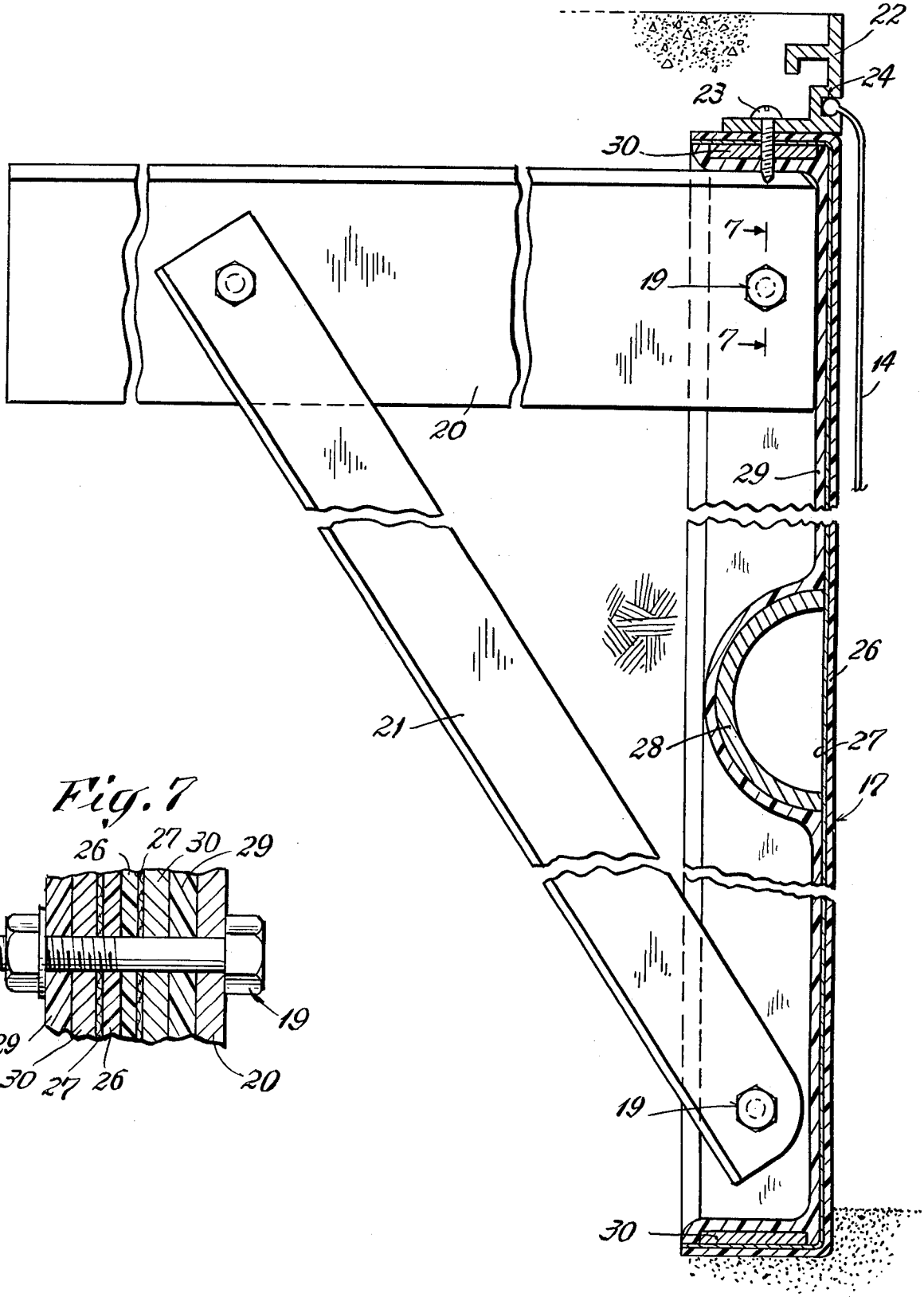
FIG. 6 is a typical vertical section, essentially full size, of the framework.
FIG. 7 is a typical cross-section of the joining of adjacent flanges.

All panels have essentially the same height and when the panels are positioned in horizontal alignment, side flanges of adjacent panels are joined together by a plurality of bolts and nuts 19. Preferably, as shown in FIG. 6, each brace 15 is formed by a horizontally extending piece of angle iron 20 and a diagonal piece of angle iron 21 with the bolts 19 securing the braces 21 to the joined side flanges. With the panels thus joined, the braces 15 attached, a coping 22 is secured, as by self-tapping screws 23, to the top periphery of the framework. The coping has the cross-sectional shape shown in FIG. 6 and includes a recess 24 into which the periphery of the liner 14, formed as a bead, is inserted and retained in place.

A larger excavation is made than required by the depression in order to provide operating room for constructing the framework and upon completion thereof, earth is back filled against the exterior of the panel to perhaps 6 inches from the top of the coping 22. Then a concrete walkway is preferably poured about the framework periphery so as to be flush with the top of the coping with the walkway being perhaps 3 or 4 feet wide. The concrete walkway and back filled earth serve to provide support preventing outward movement of the panels.

In accordance with the present invention, each of the panels consists of an essentially constant thickness of hardened polyester resin containing short fiberglass fibers. Initially, a mold is provided having a shape which is a mirror image of the inner surface of the panel to be formed, either straight or arcuate with such a mold being diagrammatically shown by the dotted line 25 in FIG. 4 for the straight panel 11. A thin layer, such as the layer 26, of the fiberglass material is formed on the mold surface. Then, a length of woven fiberglass material 27 is placed on the layer 26 and is rolled to become slightly embedded in the layer 26. On top of the woven mat 27, there are placed a plurality of rib forming elements 28 which may be spaced according to the grid configuration shown in FIG. 2. A final layer 29 of the hardenable polyester resin and fiberglass fibers is then evenly applied, as for example, by spraying, and the polyester resin of both layers is then hardened.

Prior to applying the second layer 29, flat strips 30 are also positioned against the mat 27 in the flanges. Thus, when the outer layer 29 is applied, it encases the strips 30 therein.

The rib forming elements 28 have the primary purpose of spacing the outer layer 29 away from the inner layer 26 in order to increase the rigidity of the panel. In addition however, these outward protrusions tend to minimize the possibility of deformation of the panel during the back filling operation by small stones or the back filling equipment that may be pushed against the panel and which could otherwise shatter or deform it.

The rib forming element essentially only provides for spacing the outer layer and thus need not of itself by any stronger than to be self-supporting. While any form of rib forming element may be employed, one acceptable element consists of ¼ inch thick fiberboard wall tubing of a diameter of 3 to 3½ inches divided into semi-circular lengths. In the specific embodiment shown, with a grid of five vertical elements and one horizontal element and with the panel having a height of about 39 inches, there are five pieces of tubing 38 inches long and six pieces perhaps 8½ inches long.

While the straight strips 30 are also used to space the outer layer 29 from the inner layer 26 to increase the rigidity of the panel, they also increase the thickness of the flange which facilitates connection of the coping and adjacent flanges. One form of strip that has been found acceptable consists of pressed wood chips or fibers that is typically sold under the name "Masonite" and is ⅛ of an inch thick and 1¾ inches wide.

In the forming of a panel, after the spraying of the layer 26 onto the mold and the placing of the mat 37 thereon, the mat is rolled by rollers to force it to become slightly embedded into the layer 26. While the mat 27 basically is not utilized to provide rigidity, (though it may provide some), the mat and the rolling operation assures that the inner layer 26 will be forced against the mold thereby producing a smooth inner surface 17 which is free of cavities and/or voids and projecting glass fibers. Further, it tends to assure that the layer 26 will be of essentially constant thickness. The embedded mat moreover serves as a base on which the elements 28 and strips 30 may be placed with the assurance that they will not become so embedded in the layer 26 as to appear or project through the inner surface.

With a panel of perhaps 6 ft. × 39 inches, it has been found that 25 lbs. of polyester resin and 8 lbs. of continuous strand fiber glass roving is required to produce a panel having an essentially constant thickness of about ¼ of an inch, with preferably each layer being the same thickness. The total weight of the panel essentially approximates 40 lbs. which is not so unduly heavy as to hinder the erection of the framework. It should be noted that the layers are preferably of equal thickness and that where the second layer is placed on the inner layer, the layers unite to form a unitary thickness.

A panel and the framework formed in the manner heretofor described are free of projections or rough edges that may cause rips or snags in the liner 14. Thus as shown, the corners of the panels are rounded and all connections to the panel are remote from possible contact with the liner.

An especial advantage obtained by the present invention is the elimination of the requirement called for in most building codes for metal panel pools, that the framework be grounded against electrical conduction. This elimination reduces the expense of the pool of the present invention and further obviates delays that may occur if construction is halted while waiting for personal inspection by a building code enforcement officer.

It will accordingly be understood that there has been disclosed a framework that is used with a liner to form an in ground swimming pool. The framework consists of a plurality of joined panels and each of the panels is formed of fiberglass material that is extremely resistant to deterioration over an extended period of use. Each panel, whether arcuate or straight, is caused to be rigid, self-supporting and deformation resistant in addition to being economically, competitively manufacturable by having an essentially constant thickness of fiberglass material, but with the material in the same areas being formed into two separate layers.

Variations and modifications may be made within the scope of the claims and portions of the improvements may be used without others.

We claim:

1. An in ground swimming pool framework that rests on an earth foundation for supporting a water containing flexible liner comprising a plurality of horizontally aligned elongate panels, each of said panels having a pair of horizontal and vertical edges and a smooth inner surface adapted to be engaged by the liner, peripheral flanges formed to extend from each edge rearwardly with respect to the inner surface at least along the vertical and bottom edges with the flanges having essentially flat exterior surfaces, means joining the vertical flanges of adjacent panels together to define a vertical upper wall of an in ground depression with the flat horizontal bottom surfaces of the flanges resting on the earth surface of the depression and liner support means securable to the top horizontal edge of the panels for retaining the peripheral edge of the liner and in which each of the panels is formed in situ as a one-piece unit of material consisting essentially of hardened plastic material having glass fiber strands embedded therein, said plastic material and glass fiber strands being shaped and of sufficient thickness to cause the panels to be horizontally and vertically rigid and self-supporting with said plastic material and glass fiber strands supplying essentially all of the rigidity of the panel.

2. The invention as defined in claim 1 in which the thickness of material of each panel is essentially constant throughout the extent of the panel with the thickness of the material in some portions of the panel being formed as two layers with one layer defining the inner surface and with the other layer being spaced from the one layer to project rearwardly from the panel with the said portions having both horizontal and vertical parts thereby providing the rigidity of the panel.

3. The invention as defined in claim 2 in which each panel includes means forming surfaces located at the portions with the one layer being on one side of the means forming surfaces and with the other layer being formed on the other side of the means forming surfaces and in which some of said means forming surfaces are disposed in an essentially grid pattern having horizontal and vertical parts.

4. The invention as defined in claim 2 in which the means forming surfaces include flat strips embedded in the material for essentially the complete extent of the flanges to sub-divide the material in the flanges into the two layers.

5. The invention as defined in claim 1 in which at least one of the panels has a horizontally arcuate inner surface.

6. The invention as defined in claim 1 in which each panel is shaped to be essentially horizontally and vertically symmetrical.

7. A horizontally and vertically rigid and self-supporting panel for use in forming the framework of an in ground swimming pool that uses a liner for containing the water comprising an essentially constant thickness of material consisting essentially of hardened polyester resin and strands of glass fibers which supplies essentially all of the rigidity of the panel, said material being formed in situ to provide a smooth inner surface having horizontal and vertical edges with essentially flat peripheral flanges extending rearwardly therefrom, means for dividing the material in portions of the panel into two separate layers, one of said dividing means being flat strips embedded in the material for essentially most of the extent of the flanges and another of the dividing means consistng of relatively bulky elements disposed horizontally and vertically.

8. The invention as defined in claim 7 in which each of the layers is of essentially the same thickness and in which a woven mat of glass fibers is positioned between the layers at essentially all of the portions where the layers are spaced.

9. The invention as defined in claim 7 in which the bulky elements are elongate elements that are readily collapsible.

10. The invention as defined in claim 9 in which the bulky elements are disposed in an essentially grid pattern.

* * * * *